US007324009B2

(12) United States Patent
Rastegar et al.

(10) Patent No.: US 7,324,009 B2
(45) Date of Patent: Jan. 29, 2008

(54) SELF-ALIGNING WAVEGUIDE SENSOR

(76) Inventors: Jahangir S. Rastegar, 11 Wilderness Path, Stony Brook, NY (US) 11790; Carlos M. Pereira, 1117 Oak Hill Rd., Tannersville, PA (US) 18372; Jeffrey Ge, 13 Van Brunt Manor Rd., E. Setauket, NY (US) 11733

( * ) Notice: Subject to any disclaimer, the term of this patent is extended or adjusted under 35 U.S.C. 154(b) by 390 days.

(21) Appl. No.: 10/888,485

(22) Filed: Jul. 9, 2004

(65) Prior Publication Data

US 2006/0007002 A1 Jan. 12, 2006

(51) Int. Cl.
*G08B 21/00* (2006.01)

(52) U.S. Cl. ..... 340/686.2; 340/556; 340/693.5

(58) Field of Classification Search ..... 340/556, 340/686.2, 540, 501, 693.5; 374/124, 130, 374/137; 250/221, 222.1
See application file for complete search history.

(56) References Cited

U.S. PATENT DOCUMENTS

| | | | | |
|---|---|---|---|---|
| 4,319,109 | A * | 3/1982 | Bowles | 219/626 |
| 5,541,403 | A * | 7/1996 | Heinonen et al. | 250/221 |
| 5,929,767 | A * | 7/1999 | Wallick | 340/690 |
| 5,980,104 | A * | 11/1999 | Haraguchi | 374/124 |
| 6,154,131 | A * | 11/2000 | Jones et al. | 340/540 |
| 6,239,423 | B1 * | 5/2001 | Hama et al. | 250/221 |

* cited by examiner

*Primary Examiner*—Anh V. La
(74) *Attorney, Agent, or Firm*—Scully, Scott, Murphy & Presser, P.C.

(57) ABSTRACT

A sensor unit including: two or more individual sensors; and alignment mechanism for aligning at least one of the two or more individual sensors with another sensor or a source to maximize a transmitted signal therebetween. Also provided is a method for maximizing a transmitted signal between sensors and/or sources in a sensor network. The method including: arranging two or more of the sensors in a package; and aligning at least one of the two or more sensors in the package with at least another sensor or a source.

10 Claims, 19 Drawing Sheets

SELF-ALIGNING WAVEGUIDE SENSOR

BACKGROUND OF THE INVENTION

1. Field of the Invention

The present invention relates generally to the sensors, and more particularly, to waveguide sensors capable of self-aligning with respect to one or more other waveguide sensors and/or receivers/transmitters.

2. Prior Art

In recent years, numerous sensors and sensory systems have been developed to detect and warn of the presence of chemical and biological agents, intruder detection and tracking and other similar purposes. Many of these sensors have found applications in safety, homeland security and other similar civilian and military areas. For sensors used in applications such as biological and chemical detection to be effectively used in the field, they have to be small and assembled in small packaging. The sensors must also require low power, be capable of remote operation, and must be capable of one or two-way communication with a central station or networked using some wireless technology. These are very challenging tasks and have been an area of very active research and development efforts, which has made a wide range of sensors available.

A challenging task in the development of wireless sensor capability is the development of appropriate means for alignment of sensors with each other and/or transmitters/receivers in a network of sensors. The alignment is necessary in order to maximize the transmitted/received signal. This is particularly the case for many of the homeland security applications in which the sensors cover a wide-network, such as a border or building. One method of alignment can be to place the sensors manually in an aligned fashion. However, such a method has many disadvantages, such as being inflexible to change with changing conditions. Furthermore, in some situations, such as a covert operation in a hostile territory, the sensors cannot be manually placed.

A need therefore exists for the development of sensors, in particular, waveguide sensors, having a self-aligning capability.

SUMMARY OF THE INVENTION

Therefore it is an object of the present invention to provide sensors that overcome the disadvantages associated with the prior art.

Accordingly, a sensor unit is provided. The sensor unit comprising: two or more individual sensors; and means for aligning at least one of the two or more individual sensors with another sensor or a source to maximize a transmitted signal therebetween.

The means for aligning can comprise a sphere having a spherical surface and the two or more individual sensors can comprises a plurality of individual sensors arranged about the surface of the sphere.

The two or more individual sensors can comprises a plurality of individual sensors arranged around the circumference of a circle to form a sensor cylinder. The sensor cylinder can further comprise a top and bottom plate disposed on top and bottom surfaces, respectively, to sandwich the plurality of sensors therebetween.

The means for aligning can comprise a housing having a cavity for accommodating the sensor cylinder, the housing shaped such that a central axis of the sensor cylinder is approximately perpendicular with a surface upon which the housing rests. The housing can have an elliptical shape.

The means for aligning can comprise means for suspending the sensor cylinder from the housing in a pendulum-like manner. The means for suspending can comprise at least three supporting cords disposed at one end from each of a top and bottom surface of the housing and connected to a respective top and bottom surface of the sensor cylinder at another end. Alternatively, the means for suspending an comprise a pendulum link rotatably disposed at one end from each of a top and bottom surface of the housing to a symmetrically shaped member at another end, the sensor cylinder having a cavity having a shape for mating with each of the symmetrically shaped members and for disposing the symmetrically shaped members therein.

The means for aligning can comprise a housing for disposing the sensor cylinder at least partially therein, the housing having two or more deployable extensions, which deploy upon impact of the housing with a surface.

The means for aligning can comprise a spherical housing having a cavity for accommodating the sensor cylinder and two or more spherical rollers disposed on the sensor cylinder in contact with an interior surface of the spherical housing. The means for aligning can further comprise a hollow cylindrical container disposed on the sensor cylinder, the hollow cylindrical container having a weight slidingly disposed therein.

The means for aligning can comprise a spherical housing having a cavity for accommodating the sensor cylinder and a spherical section connected to each of a top and bottom surface of the sensor cylinder. The means for aligning further comprises a hollow cylindrical container disposed on the sensor cylinder and spherical sections, the hollow cylindrical container having a weight slidingly disposed therein.

The means for aligning can comprise a spherical section connected to each of a top and bottom surface of the sensor cylinder and a hollow cylindrical container disposed on the sensor cylinder and spherical sections, the hollow cylindrical container having a weight slidingly disposed therein.

The aligning means can comprise one or more actuators under the control of a controller for aligning at least one of the two or more sensors with the other sensor or the source. The two or more sensors can be connected together into a sensor package and the one or more actuators can be operatively connected to the sensor package. Alternatively, the one or more actuators can be operatively connected individually to one or more of the two or more sensors.

Also provided is a sensor package comprising a plurality of sensors arranged about a circumference of a cylinder.

Still further provided is a sensor package comprising a plurality of sensors arranged about a surface of a sphere. Still yet further provided is a method for maximizing a transmitted signal between sensors and/or sources in a sensor network. The method comprising: arranging two or more of the sensors in a package; and aligning at least one of the two or more sensors in the package with at least another sensor or a source. The aligning can be done passively or automatically with the use of actuators.

BRIEF DESCRIPTION OF THE DRAWINGS

These and other features, aspects, and advantages of the apparatus and methods of the present invention will become better understood with regard to the following description, appended claims, and accompanying drawings where:

DETAILED DESCRIPTION OF THE PREFERRED EMBODIMENT

The present invention discloses sensors having a self-aligning capability. Although many types of sensors can be utilized, one particular type of sensor that has particular utility herein are RF waveguide sensors disclosed in co-pending U.S. patent application Ser. No. 10/888,379, the disclosure of which is incorporated herein in its entirety by its reference.

A number of self-aligning RF waveguide sensor platforms are disclosed. Such sensor platforms are necessary to eliminate the requirement for manual adjustment of the waveguide sensors, thereby making them suitable for deployment from a safe distance as a node for wide-area intruder and object detection and tracking networks. The waveguide sensors have to be aligned with the transmitting source or with other waveguides located at interconnected nodes with which they are in communication, in order to maximize the transmitted signal. In the present disclosure, the orientation adjustable mechanisms are described in terms of RF waveguide sensors. The use of the disclosed self-aligning RF waveguide sensor platforms is, however, not limited to RF waveguide sensors. In fact, they can be used in any application in which a sensor platform or other similar platforms may require similar position and orientation adjustments, for example to properly deploy a sensor. The disclosed embodiments are particularly suitable for remote deployment by gun-fired projectiles, but may also be deployed by other means such as airplanes, helicopters, or even manually from a moving vehicle. Systems and methods for deployment of waveguide sensors and other sensor types is disclosed in co-pending U.S. application Ser. No. 10/888,361, the disclosure of which is incorporated herein by its reference.

Figure 1:
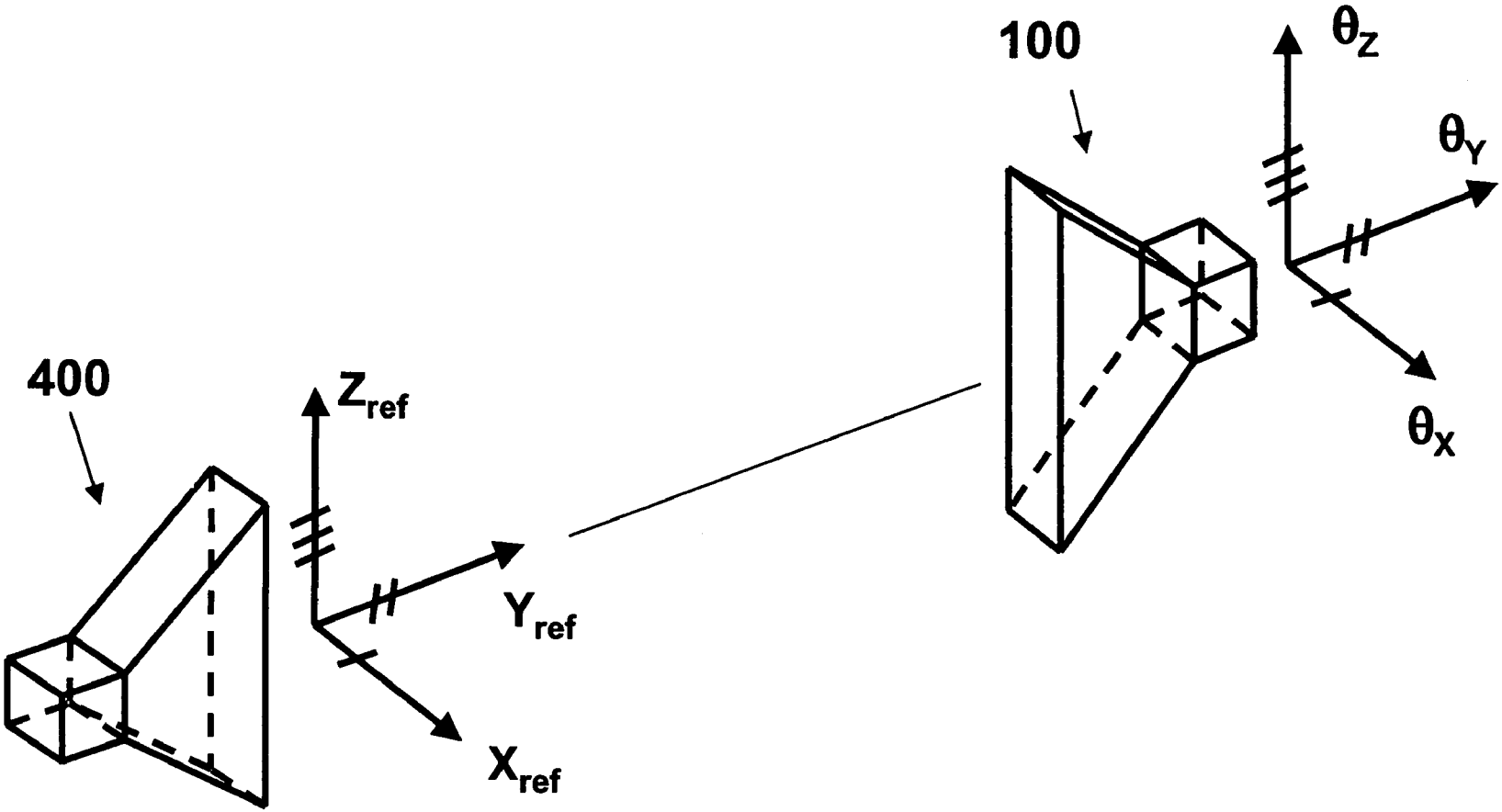
FIG. 1 illustrates a schematic of a polarized RF source and a sectoral horn waveguide sensor.

In an embodiment of the present invention, the self-aligning waveguide sensor platforms are constructed with a number of waveguide cavities. In addition, as shown in FIG. 1, sectoral horn type waveguides 100 are used with a source 400 intended to be transmitting a polarized RF signal. Such waveguides 100 generally require angular orientation adjustment in three relative independent directions. For example, the sectoral horn waveguide 100 shown in FIG. 1 requires three independent orientational adjustments relative to the sectoral horn waveguide source 400 transmitting polarized RF signals, e.g., rotations about the axes $\theta_X$, $\theta_Y$, and $\theta_Z$ in the Cartesian coordinate system XYZ fixed to the waveguide sensor, relative to the Cartesian coordinate system $X_{ref}Y_{ref}Z_{ref}$, fixed to the source 400. On the other hand, as shown in FIG. 2, if the signal being transmitted from the source 400*a* is not polarized, a cone shaped waveguide sensor 100*a* due to symmetry about the long axis of the cone 100*b*, requires alignment only about the axes $\theta_Y$, and $\theta_Z$.

The self-aligning sensor platforms may therefore be classified as those providing one, two or three degrees of independent orientation adjustments. The self-aligning sensor platforms being disclosed in this invention are intended to allow orientation alignment about up to three independent axes for waveguide sensors 100 relative to their illuminating source(s) 400 and other waveguide sensors 100 that may be positioned elsewhere in a sensory network. Although only one waveguide sensor 100 and source 400 are shown, those skilled in the art should appreciate that a plurality of such waveguide sensors 100 and/or sources 400 can be used in a network, which could cover a wide area. Each of the waveguide sensors in the network are alternatively referred to herein as a node in the network.

Figure 2:
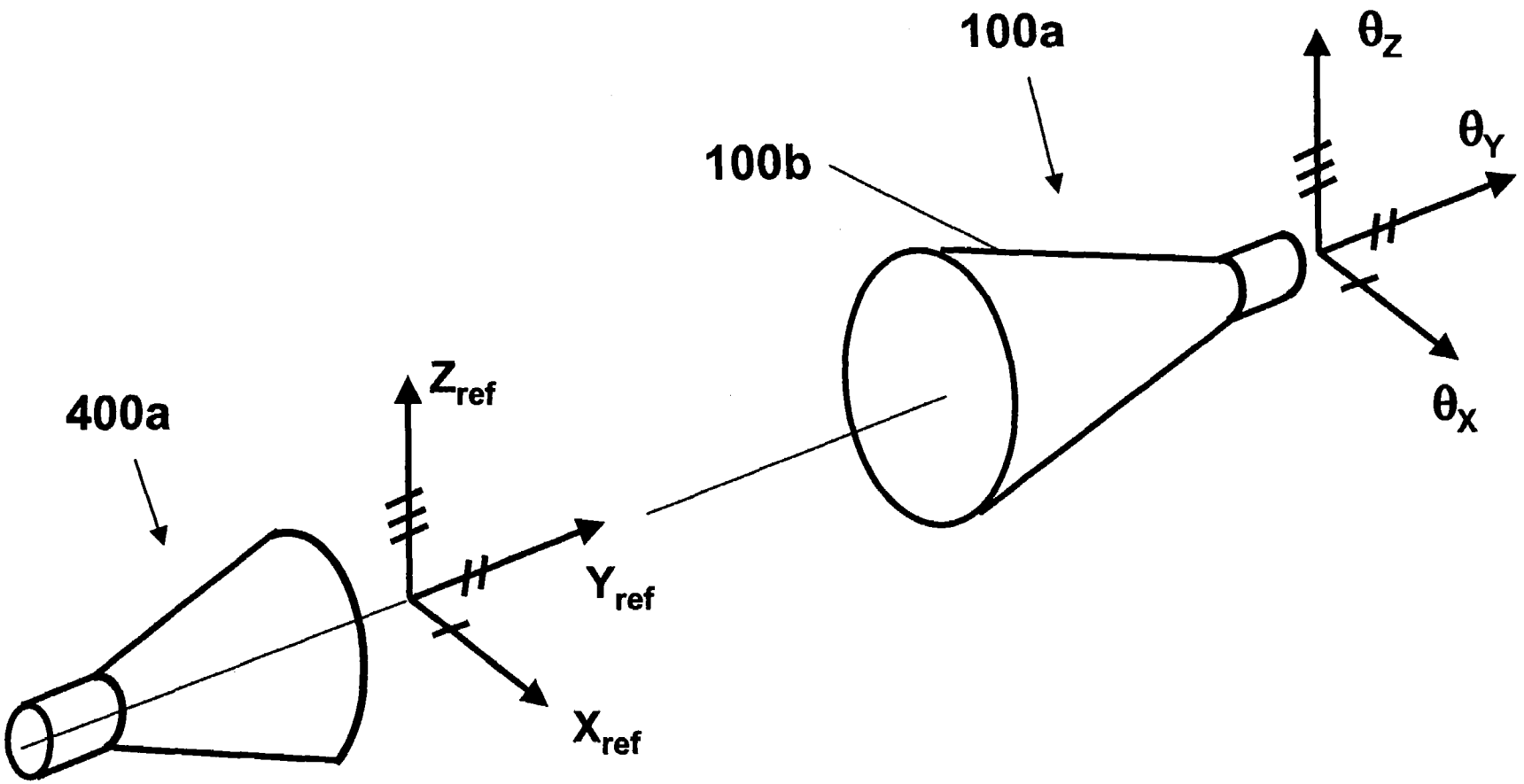
FIG. 2 illustrates a schematic of a polarized RF source and a conical horn waveguide sensor.

In general, the waveguide sensor 100 and the source 400 as shown in FIGS. 1 and 2, or any pair of communicating waveguides, have to be aligned within a few degrees, which is dependent on the design of the waveguide, the frequency of the RF signal, the method of communication, the method of data processing, environmental noise level, the distance between the two, etc. For example, in many cases, alignment angles of around 4-5 degrees may be appropriate for transmitting intruder detection and tracking pulses without requiring the transmission of information, at least not at a high rate.

Figure 3:
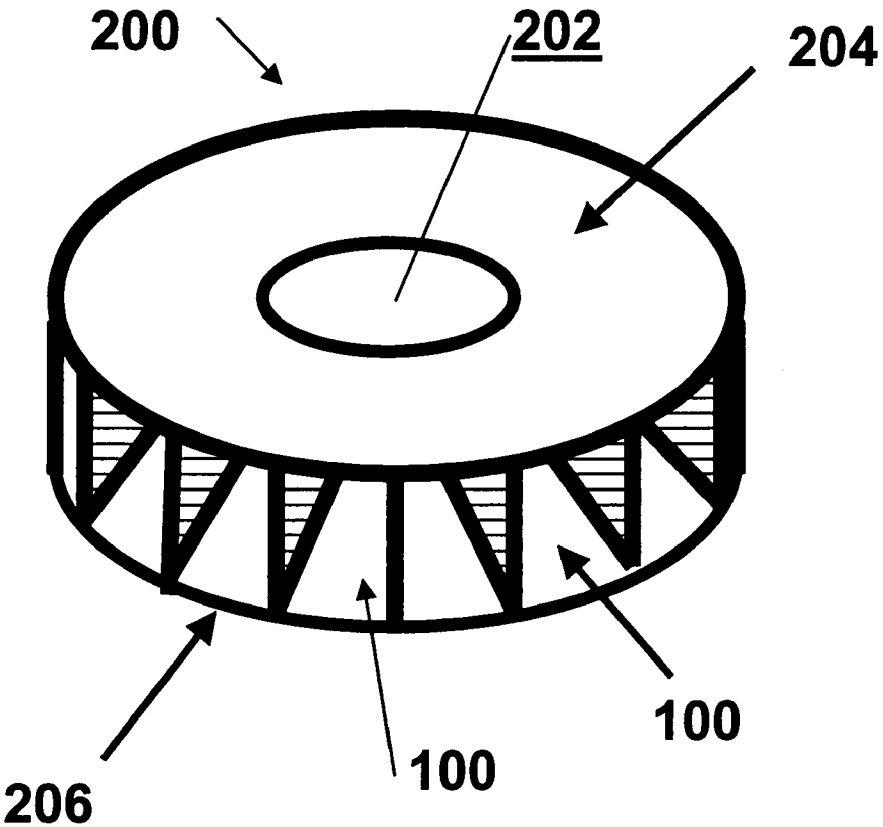
FIG. 3 illustrates a perspective view of a sensor package in the shape of a cylinder.

In one embodiment of the present invention, a self-aligning method and mechanism is provided when two independent orientation alignments are needed. In this embodiment, a number of waveguide sensors 100 are assembled to form a cylindrical shape as shown in FIG. 3 and the top view thereof in FIG. 4. Such a configuration of waveguide sensors will hereinafter be referred to as a "sensor cylinder" 200. The electronics and the power source (if any) are preferably positioned in the available spaces between the individual waveguide sensors 100 and in the center area 202 of the sensor cylinder 200. The electronics and power supply are not shown in detail because it is within the skill of those of ordinary skill in the art to provide such features within the sensor cylinder 200. In this embodiment, the sensor cylinder 200 is packaged in a housing that ensures that upon landing, the sensor cylinder 200 is nearly vertical. This can be accomplished by making the shape of the sensor cylinder 200 of the packaging such that when placed on a flat or nearly flat surface, it would be stable only if it has landed on either top or bottom surfaces (corresponding to the top and bottom surfaces of the sensor cylinder). On way of accomplishing such stability is to place the waveguide sensors 100 between top and bottom discs 204, 206 or otherwise assemble the waveguide sensors 100 to form such top and bottom surfaces. If the diameter of the sensor cylinder 200 is much greater than a height of the sensor cylinder than it will be most stable when it is lying on one of the top or bottom discs 204, 206. Accordingly, if the sensor cylinder 200 lands on an edge of the sensor cylinder 200, it will be in an unstable orientation and will tend to stabilize itself by falling into the position shown in FIG. 3.

Figure 4:
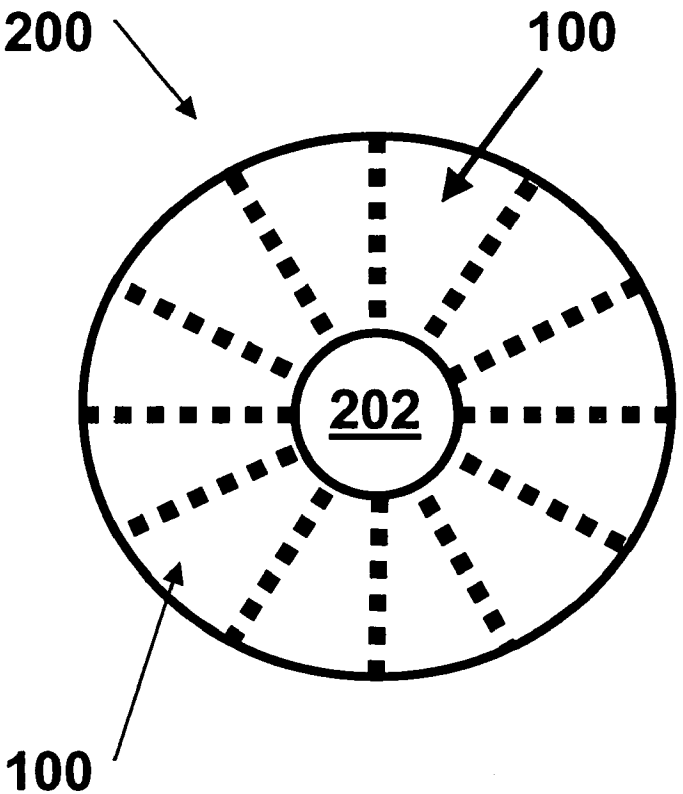
FIG. 4 illustrates a top view of the sensor cylinder of FIG. 3.

Note that even though a symmetrical cylindrically shaped assembly is shown in FIGS. 3 and 4 the assembly may take any other shape as long as its height to the smallest of the "top" area dimensions is small enough to force it land only on its opposite "top" or "bottom" surfaces. The waveguide sensor 100 elements are preferably positioned centered along the height of the sensor cylinder 200, but may be positioned at any available position on the periphery of the sensor cylinder 200 and do not have to be positioned along the entire perimeter of the sensor cylinder 200 but may be positioned along any portion(s) thereof.

Figure 5A:
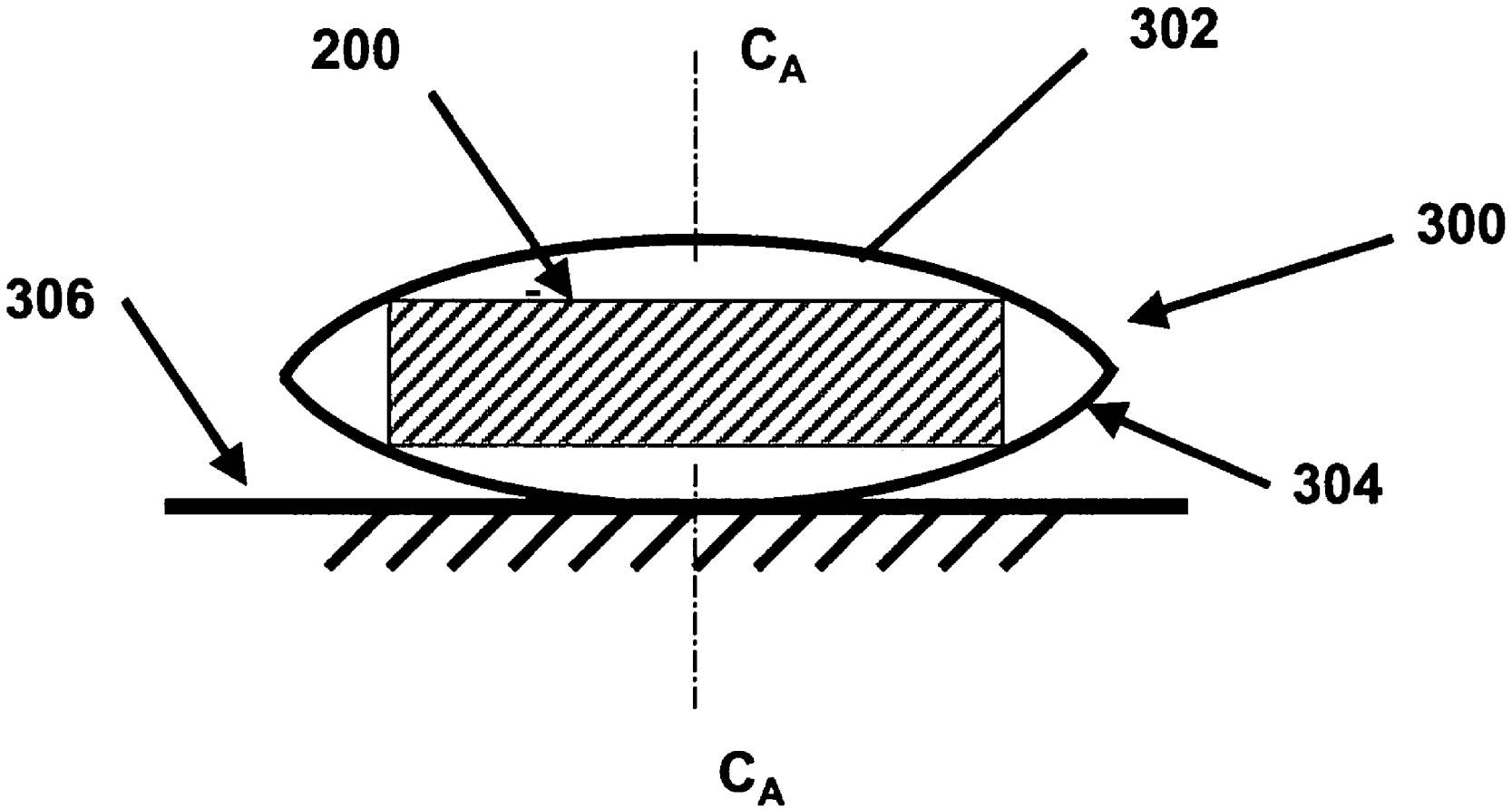
FIG. 5*a* illustrates a sectional view of an embodiment of the sensor cylinder disposed in a housing.

Another embodiment of such a design is shown in FIG. 5*a* where the sensor cylinder 200 is packaged in a flattened elliptically shaped housing 300. The housing 300 may be a complete shell or just a framed structure. With such an outer shell housing 300, the unit (combined sensor cylinder and housing) may only come to rest on one of its upper or lower surfaces 302, 304 upon landing, thereby bringing the sensor cylinder 200 to a near "flat" position, i.e., with the center axis $C_A$ of the sensor cylinder 200 nearly vertical (normal to the surface 306 of landing). The housing 300, particularly of the framed structure form, may be designed to deploy, i.e., take the intended shape, before landing to make the sensor packaging prior to deployment compact. The housing 300 may deploy after being deployed (e.g., being fired from a gun based delivery system) by any means known in the art, such as by being biased in a compact configuration and using charged fasteners to release the biasing forces and allow the housing to expand to a larger configuration.

Figure 5B:
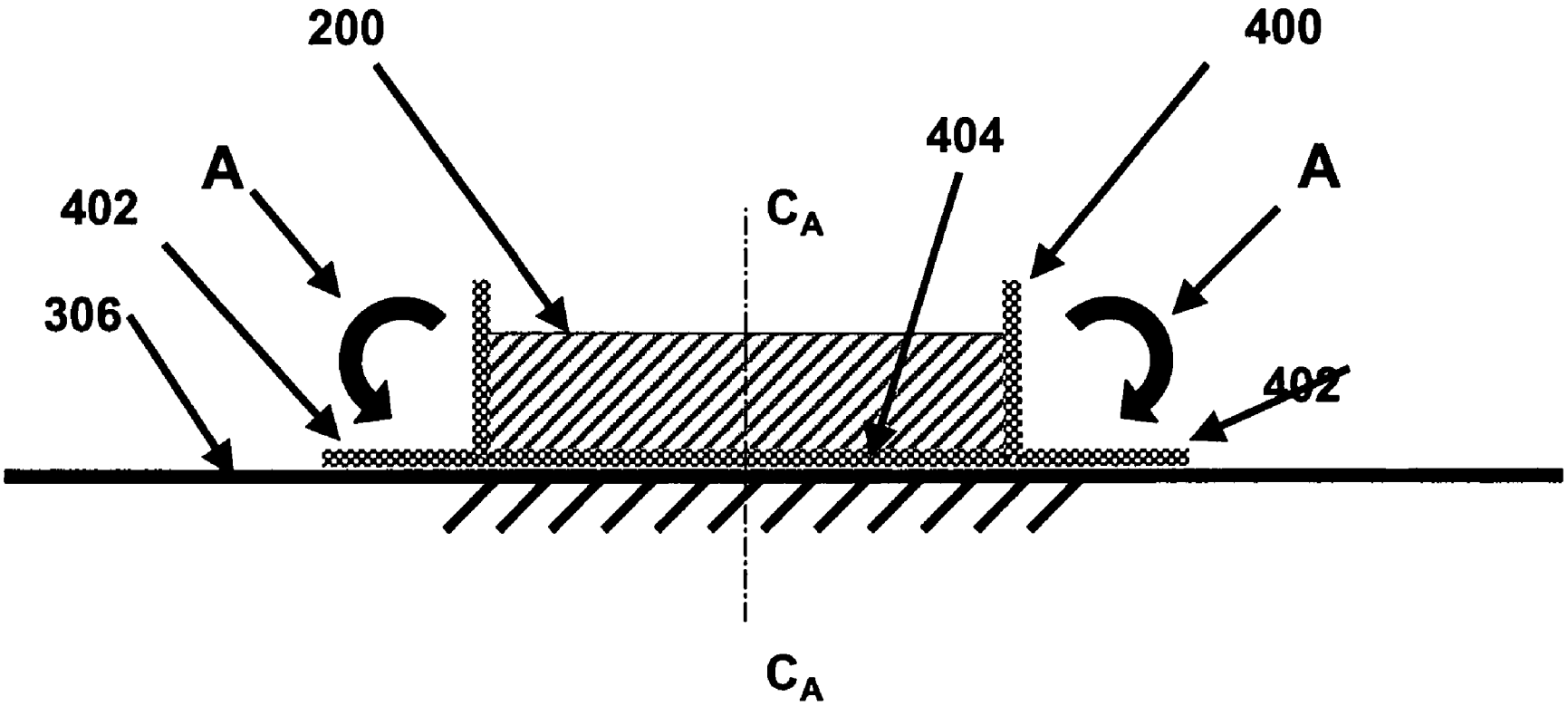
FIG. 5*b* illustrates a sectional view of an embodiment of the sensor cylinder disposed in a housing with deployable side edges.

Another embodiment of such a design is shown in FIG. 5*b*. This design is to keep the (radial) size of the unit (housing and sensor cylinder) as small as possible. As can be seen, the sensor cylinder 200 contains deployable side edges 400 that may be in the form of plates, spokes, etc., that are deployed before landing in the direction of Arrow A into a deployed position 402 before contact with a surface 306. The deployable side edges 400 can be integral with the sensor cylinder 200 or part of a housing 404. As many of such relatively long but slim protrusions (side edges 400) are deployed, e.g., every 45 degrees around the sensor cylinder 200 in order to force the sensor cylinder/unit 200 to land on its top or bottom surface, thereby essentially rendering its long axis $C_A$ as vertical as the landing site allows.

The embodiments shown in FIGS. 5*a* and 5*b* are intended to position the waveguide sensor cylinder 200 assembly flat on a ground or other surface 306, as parallel to the horizontal plane as the landing surface allows. In these embodiments, the sensor cylinder 200 is fixed inside the housing, thereby the accuracy with which the waveguide cylinder 200 is going to be parallel to the horizontal plane, i.e., the axis $C_A$ of sensor cylinder 200 be vertical, is dependent on the flatness of the landing site. If this "flatness" accuracy is acceptable the embodiments of FIGS. 5*a* and 5*b* are cost effective because they are totally passive.

Figure 6B:
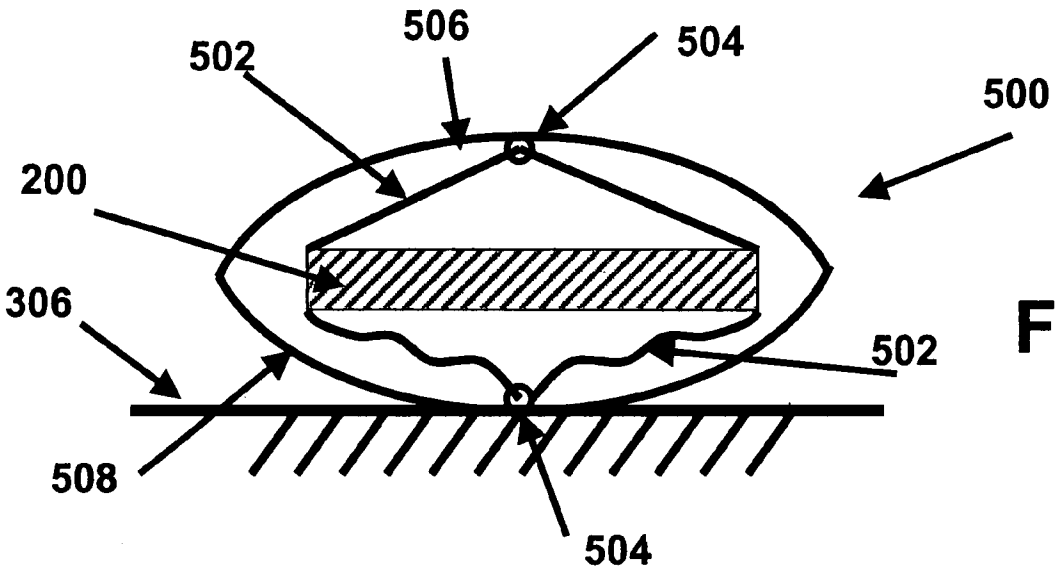
FIG. 6*b* illustrates a sectional top view of the sensor cylinder and housing of FIG. 6*a*.
Figure 6A:
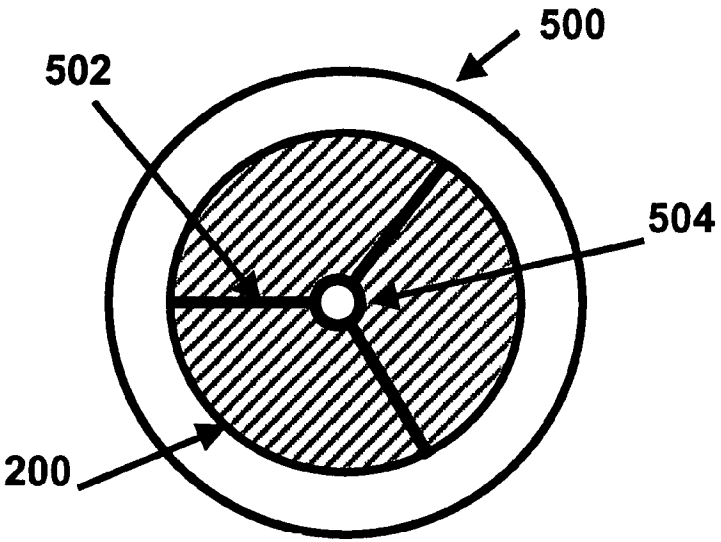
FIG. 6*a* illustrates a sectional view of an embodiment of a sensor cylinder disposed in a housing.

If the accuracy with which the sensor cylinder 200 could land is not acceptable, a sensor cylinder such as that shown in FIGS. 6*a* and 6*b* can be used. In this embodiment, the sensor cylinder 200 is "floating" inside a housing 500 and allowed to take a nearly flat position due to the force of gravity. As shown in FIGS. 6*a* and 6*b*, the sensor cylinder 200 is essentially suspended from the housing 500 by a set of three or more relatively inextensible but flexible cords 502 from a cord attachment joint 504, in a pendulum-like manner. Since the housing 500 may land on either side, two sets of such cords 502 are loosely assembled on both sides of the sensor cylinder 200 so that no matter on which side the housing 500 comes to rest on the ground or other surface 306, the sensor cylinder 200 is suspended, pendulum like, from one of the sides 506 of the housing 500 as shown in FIG. 6*a*. This is accomplished by making the cords 502 long enough so that those on the landing side 508 of the housing 500 stay loose, thereby allowing the upper set of cords 502 to determine the position at which the sensor platform 200 would come to rest.

Figure 7:
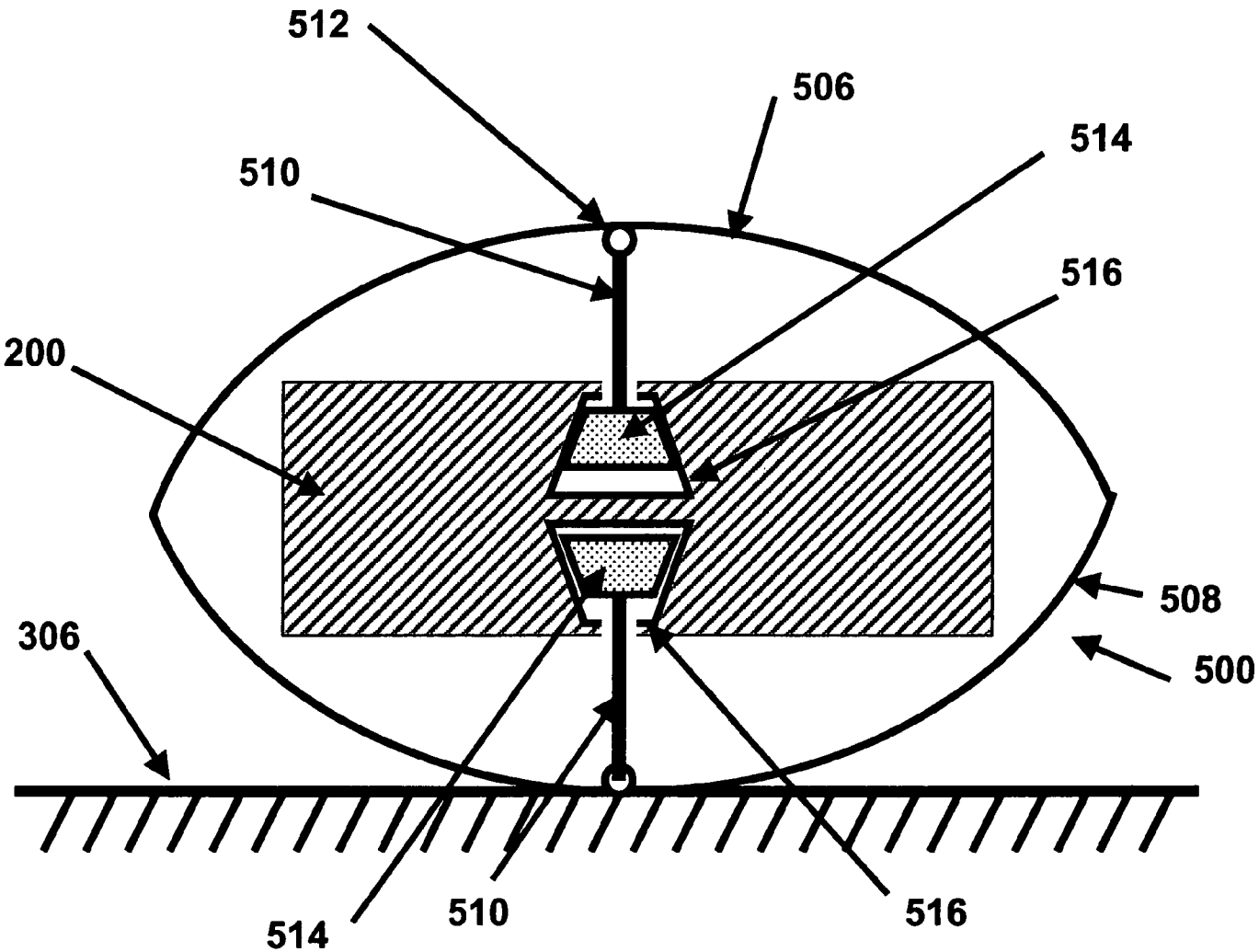
FIG. 7 illustrates a sectional view of an embodiment of an alternative sensor cylinder disposed in a housing.

It should be appreciated by those skilled with the art that pendulum-like suspension may also be achieved using other means, such as a simple rod with a seating arrangement such as the conical seats shown in the cross section view of FIG. 7. In this embodiment, pendulum-like suspension mechanisms on either side of the sensor cylinder 200 each consist of a pendulum link 510 that is attached to the housing 500 on one side by a joint 512 that allows rotation about all axes except about itself (the purpose of such rotational restriction is described below). On the other end of the pendulum link 510, a cone 514 or other similarly shaped element with inclined sides is symmetrically attached. Mating cones cavities 514 are also provided centrally on either side of the sensor cylinder 200. The latter cavities 526 are longer than the height of the cones 514 attached to the pendulum link 510, so that it the cones 514 freely float within the cavity 516 unless the sensor cavity 516 is pulled to the opposite side, which occurs for the top pendulum link as shown in FIG. 7. While suspended, the opposite (bottom) pendulum link 510(constructed in a similar manner as the top pendulum link) and its conical element 514 do not constrain rotation and/or translation of the sensor cylinder 200 while it is moving close to being positioned essentially parallel to the horizontal plane.

A basic characteristic of such pendulum-like suspension mechanisms is that they are constructed such that if the housing 500 lands on either of its sides 506, 508, one or the other mechanism, normally located on the top side of the sensor cylinder 200, functions as the pendulum-like suspension mechanism, while the mechanism of the opposite allows free translation and rotation about at least two independent axes parallel to the plane of the sensor cylinder 200. The top mechanism must obviously also allow rotations about the latter axes. Either top or bottom mechanism are preferably used to constrain rotation of the sensor cylinder 200 about an axis that is parallel to its central axis, i.e., the vertical axis ($C_A$). In both embodiments shown in FIGS. 6*a* and 7, the attachment points to the housing preferably allow the aforementioned two degrees of independent rotation needed for the force of gravity to bring the sensor cylinder as close to being parallel to the horizontal plane as possible, while preventing it to rotate about an axis perpendicular to the horizontal plane. Such a two degrees-of-freedom joint is equivalent to a universal joint.

A primary purpose for restricting the sensor cylinder 200 from rotation about a vertical axis ($C_A$) is that over time, the cylinder be prevented from such rotations due to wind or the like, and thereby degrading the alignment of the waveguide sensors 100.

Figure 8A:
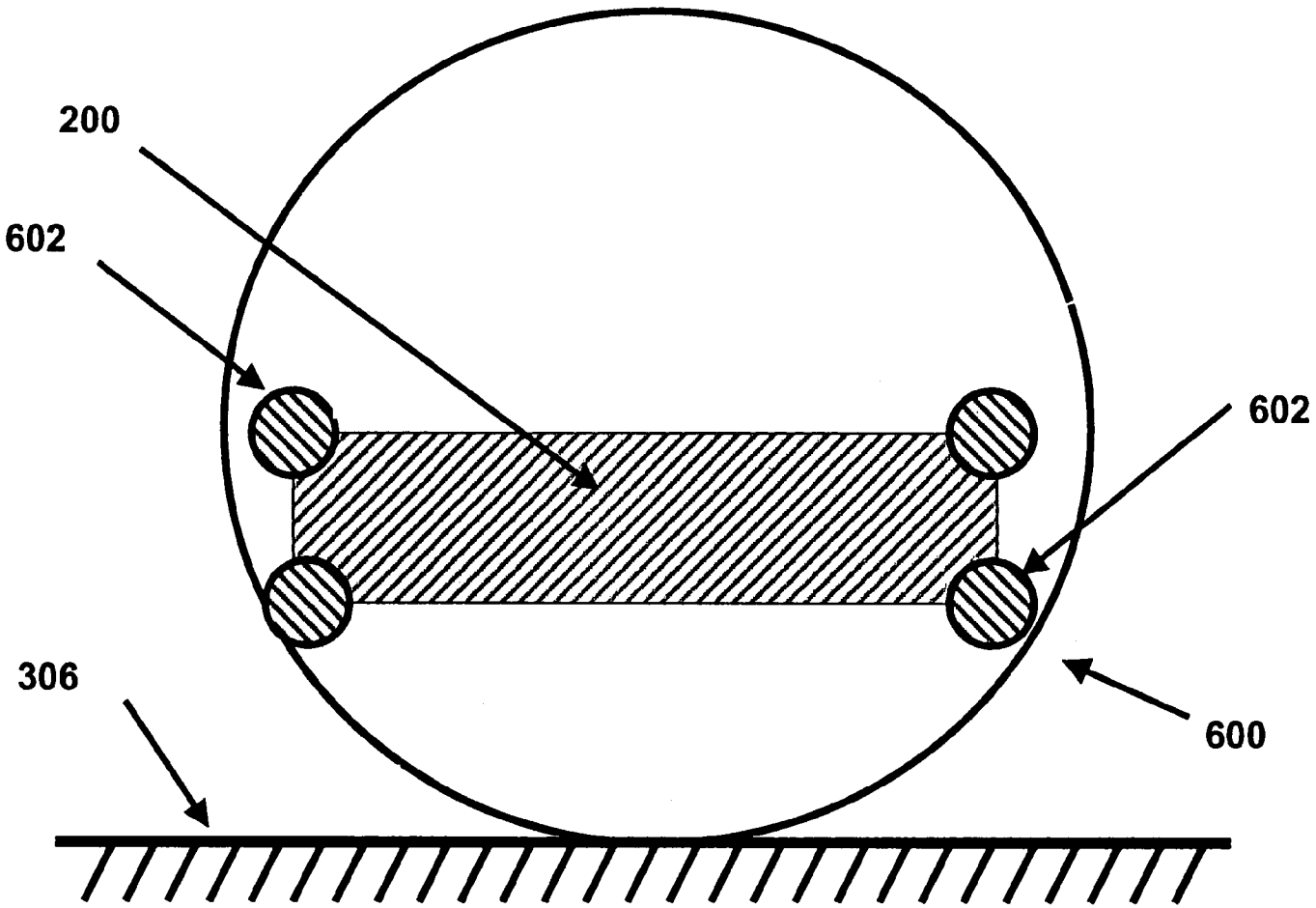
FIG. 8*a* illustrates a sectional view of an embodiment of a sensor cylinder disposed in a housing.

Referring now to FIG. 8*a*, there is shown yet another embodiment of the present invention wherein the outer housing 600 is constructed as a sphere. The sensor cylinder 200 is also provided with the means to slide freely inside the housing sphere 600, thereby assuming nearly horizontal position. A number of methods may be used to provide for free sliding motion of the sensor cylinder 200 within the spherical housing 600. This includes the use of three or more spherical "wheels" 602 positioned on both top and bottom sides of the sensor cylinder 200 and around the sensor cylinder, for example every 60 degrees (for a total of 6 spherical rollers). The spherical rollers 602 can be rotatably attached to the sensor cylinder 200 in any way known in the art.

Figure 8B:
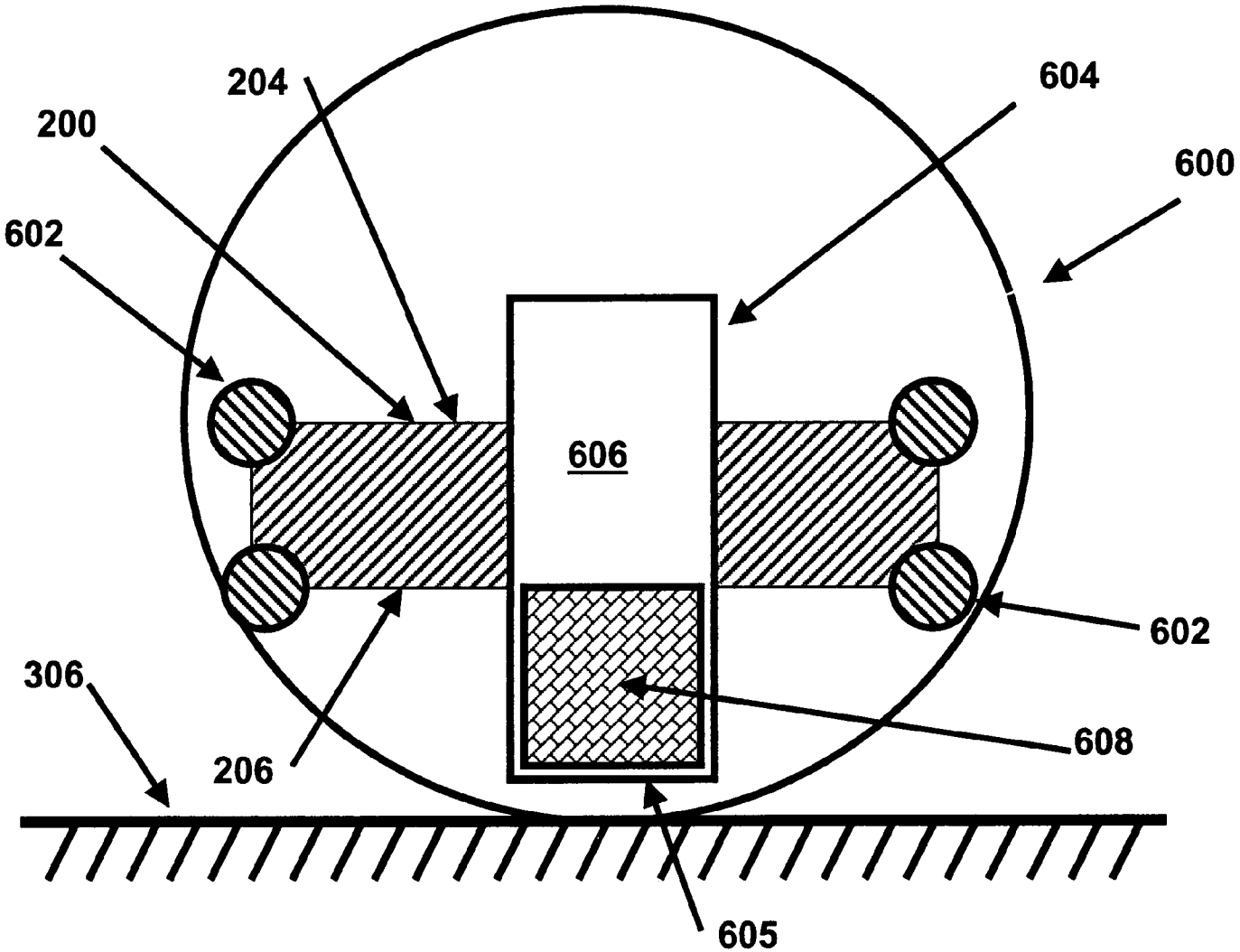
FIG. 8*b* illustrates a sectional view of an embodiment of an alternative sensor cylinder disposed in a housing.

Referring now to FIG. 8*b*, another version of this embodiment is shown. In FIG. 8*b*, a cylindrical shaped hollow container 604 is placed at the center of the sensor cylinder 200. The container has a hollow space 606, hereinafter called the "central cavity", which may be circular or any other shape in cross-section, and which can be symmetrical about the central axis $C_A$ of the sensor cylinder 200. The hollow cylindrical container 604 can extends far, above and below the sensor cylinder 200 top and bottom surfaces 204, 206, but should clear the housing 600 below the sensor cylinder 600 (allow the rollers 602 to contact the interior walls of the housing 600). An object (weight) 608 with relatively large mass, is disposed in the central cavity 606 and is permitted to freely float up and down the hollow cylindrical container 604. Upon landing on the ground or other surface 306, the weight 608 will drop towards a bottom surface 605 of the hollow cylindrical container 604, thereby causing the gravitational force to bring the sensor cylinder 200 as close as being parallel to the horizontal plane as possible and will also act to stabilize the sensor cylinder 200 in such a position.

Figure 9A:
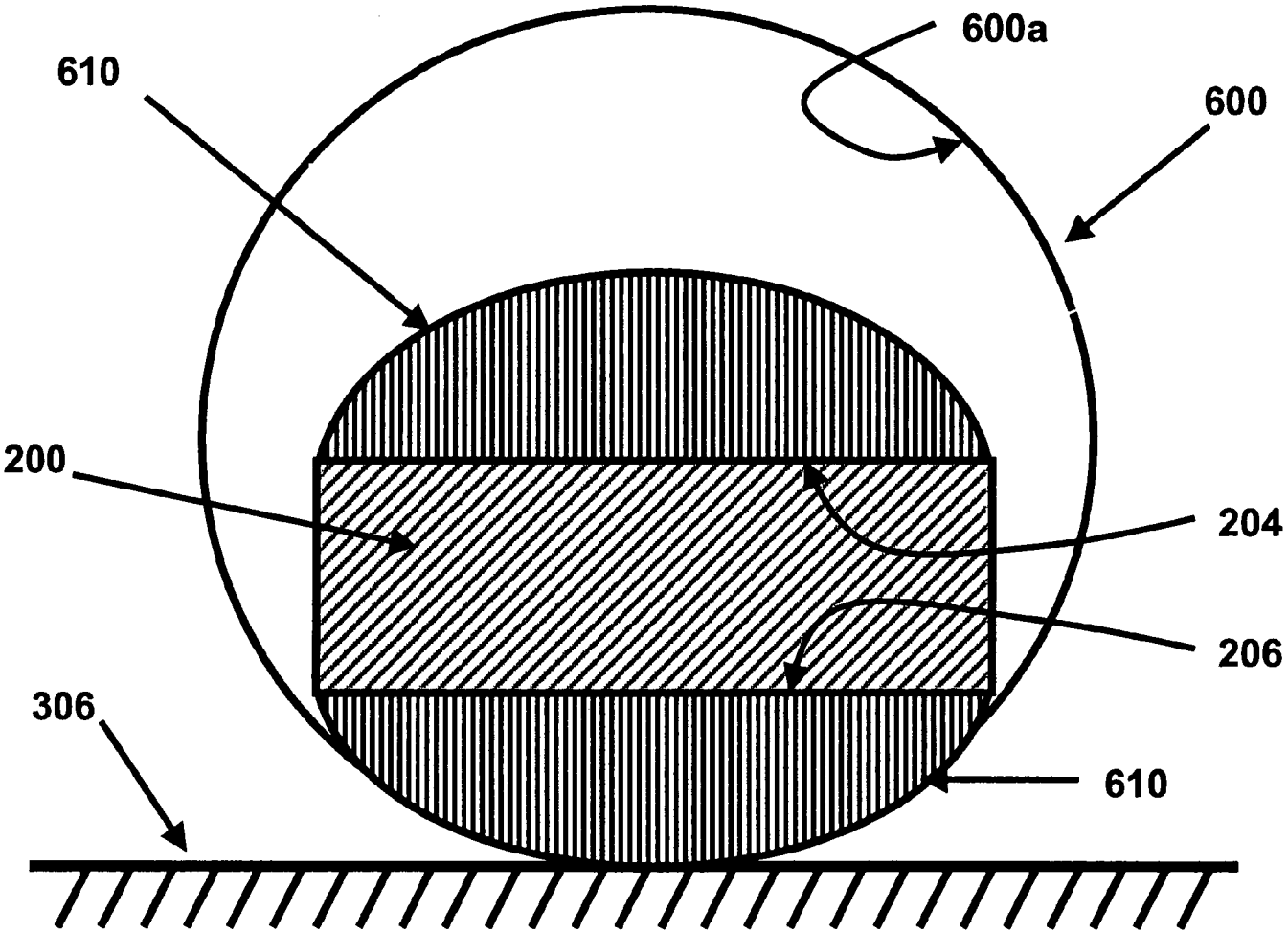
FIG. 9*a* illustrates a sectional view of an embodiment of a sensor cylinder disposed in a housing.
Figure 9B:
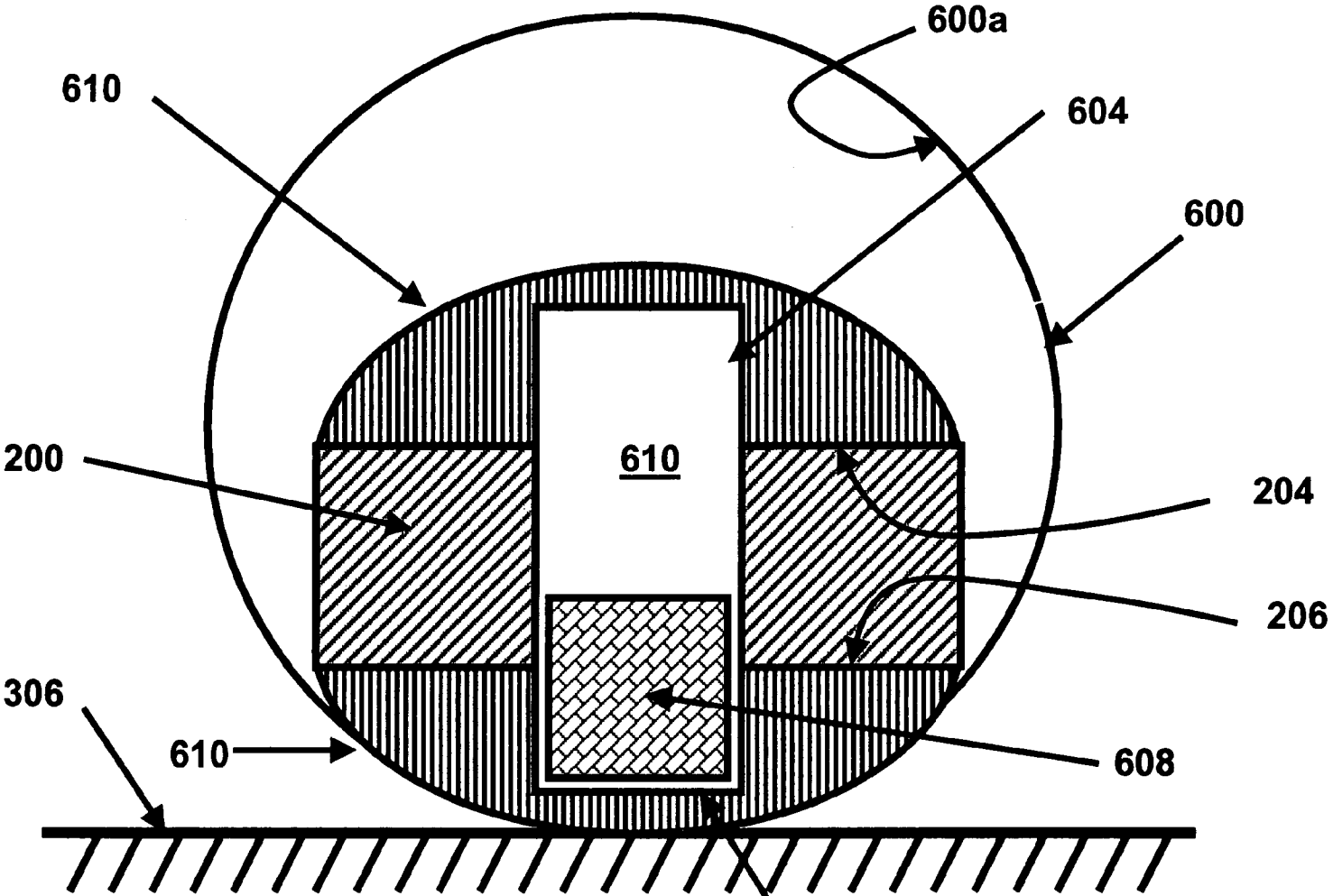
FIG. 9*b* illustrates a sectional view of an embodiment of an alternative sensor cylinder disposed in a housing.

In another such embodiment, sections of a sphere 610 are attached to the top and bottom surfaces 204, 206 of the sensor cylinder 200 as shown in FIG. 9*a*. By providing lubricated and smooth inner surfaces 600*a* for the housing 600 and for the spherical sections 610, upon landing on the ground or other surface 306, the sensor cylinder 200 will assume near horizontal positioning. In another version of this embodiment, the gravitational force available to force the sensor cylinder 200 into a horizontal position is increased by providing its assembly with the hollow cylindrical container 604 and its interior floating weight 608 similar to that shown in FIG. 8*b*. Such an embodiment is shown in FIG. 9*b* in which like features to that shown in FIG. 8*b* are indicated with like reference numerals.

It should be noted that the spherical housing shown in the embodiments of FIGS. 8*a*, 8*b*, 9*a* and 9*b* is only required to have an inner spherical geometry, while the exterior surface of the housing may assume any arbitrary shape. Furthermore, although the housings discussed above are shown in cross-section as a single line, it is done so for purposes of illustration only and is assumed to have a thickness sufficient to withstand landing on the ground or other surface 306. Various materials for the housings are known in the art, such as aluminum, titanium, steel, plastics, and carbon fibers. However, such material and thickness must permit transmission of signals into and/or out from the housing. Thus, wherever necessary, the outer housing is at least partially constructed with materials that are nearly transparent to the utilized RF electromagnetic radiation frequency spectrum.

Although not shown, the housings are intended to permit insertion and/or removal of the sensor cylinders 200 therein, such as having a "clamshell" configuration as is known in the art. Clamshell design can be configured to permit repeated opening and closing or can be permanently closed with the sensor cylinder 200 therein. The housing can also be sealed to the outside environment as is known in the art.

To reduce or eliminate friction between the sensor cylinder 200 and the interior surfaces of the housing for all the above embodiments, the space between the sensor cylinder 200 and the interior surfaces of the housing can be filled with a gel or a gel-like material. Packing the housing within a canister or in some sealed container during the launch and landing may do this. However, the gel or gel-like material must permit transmission of signals into and/or out from the housing.

Figure 10:
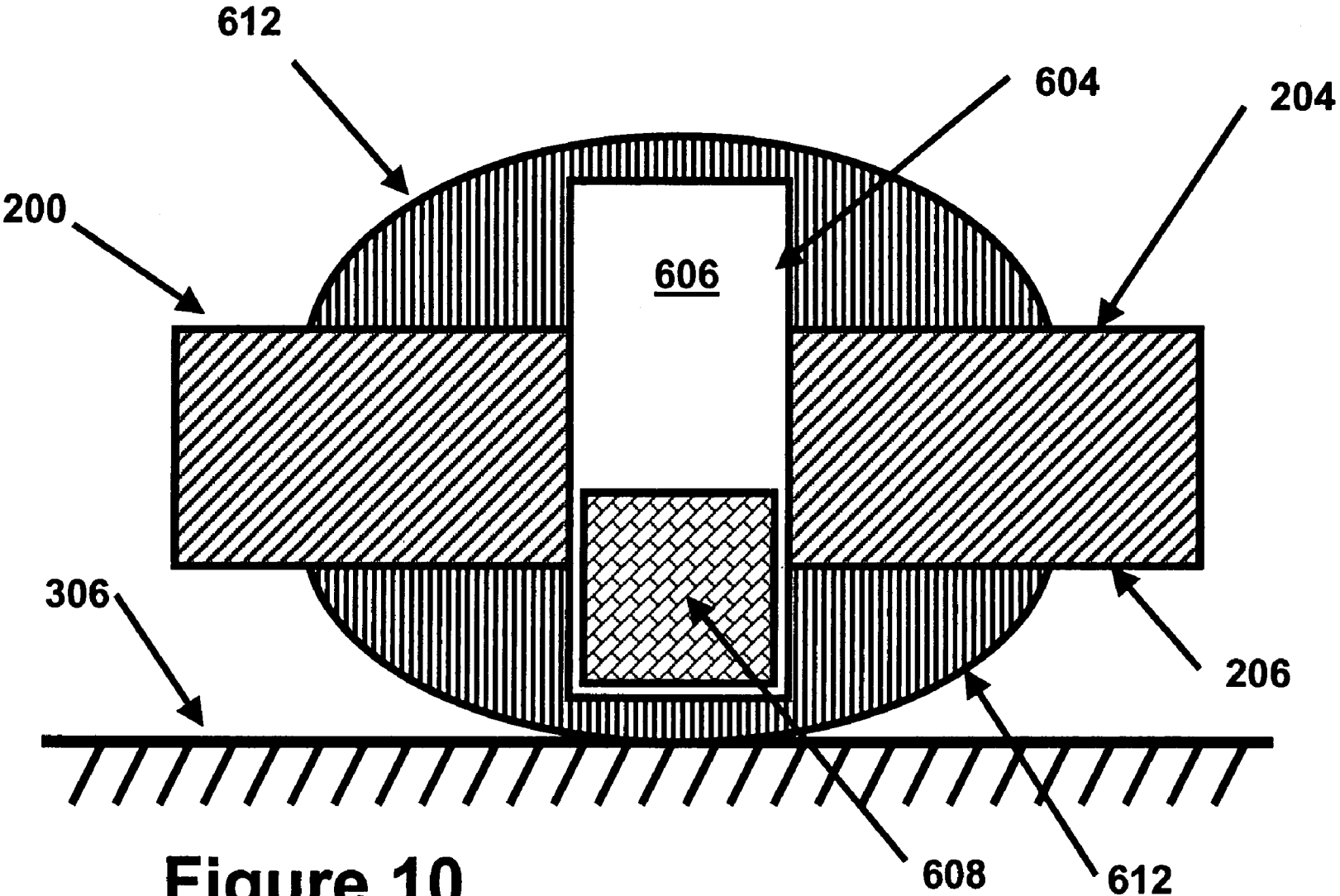
FIG. 10 illustrates a side view of a sensor cylinder having spherical sections attached to upper and lower surfaces thereof.

Referring now to FIG. 10, in another embodiment of the present invention, the sensor cylinder 200 is provided with sections of a sphere 612, which are attached to the top and bottom surfaces 204, 206 of the sensor cylinder 200 similar to the embodiment shown in FIGS. 9*a* and 9*b*. Furthermore, the center of the sensor cylinder can be hollow, with the hollow space 606 extending far into the top and bottom spherical sections 612 similar to the configuration shown in FIGS. 8*b* and 9*b*. Upon landing, a weight 608 disposed in the hollow space 606 will drop towards the bottom surface of the lower spherical section 612, thereby causing the gravitational force to bring the sensor cylinder 200 as close as being parallel to the plane of landing as possible.

In the embodiments shown in FIGS. 5*a*, 5*b*, and 10, the sensor cylinder 200 tends to be positioned parallel to the landing or the ground plane, i.e., a plane tangent to the bottom surface at the point of contact with the ground (assuming a perfectly flat and hard ground). For this reason, these embodiments may have particular utility for deployment on sloped surfaces. However, these embodiments have the disadvantage of their final positioning of the sensor cylinder being sensitive to the landing ground condition. The embodiments shown in FIGS. 6*a*, 6*b*, 7, 8*a*, 8*b*, 9*a* and 9*b* on the other hand will always position the sensor cylinder nearly parallel to the horizontal plane, i.e., perpendicular to the direction of the gravity vector. For this reason, these embodiments are preferred for deployment on essentially flat surfaces and the final positioning of the sensor cylinder 200 is not sensitive to the conditions of the landing ground.

Figure 11:
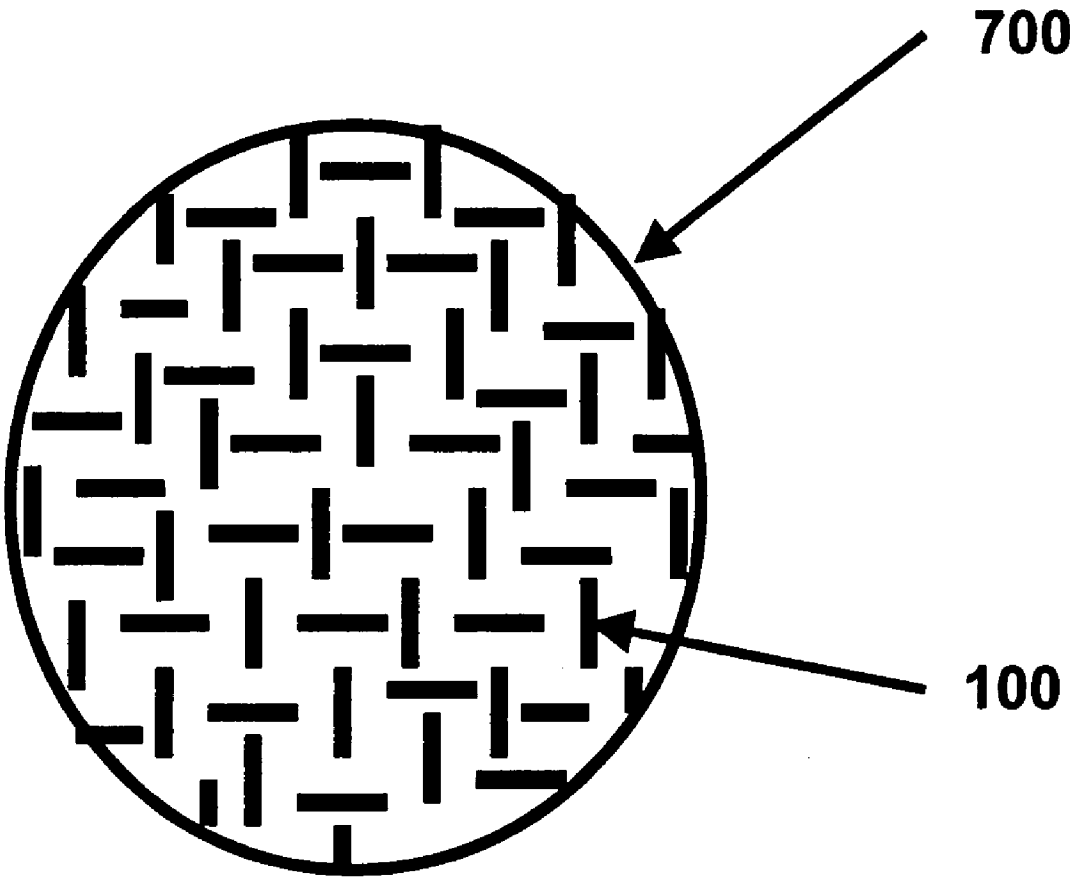
FIG. 11 illustrates a sensor package in the form of a sphere and having waveguide sensors disposed on the surface thereof.

Referring now to FIG. 11, in another embodiment, waveguide sensors 100 are distributed over the surface of an spherically shaped platform 700 (e.g., a ball shaped platform). The waveguide sensors 100 are shown in FIG. 11 by a short line segment for purposes of illustration only. By providing enough waveguide sensors 100 over the surface of the spherically shaped platform 700, one of the waveguides 100 will always be aligned with other facing waveguide sensors 100 or sources 400. The accuracy with which such alignments can be reached is dependent on how closely the waveguide sensors 100 are packed over the surface of the spherically shaped platform.

All the aforementioned embodiments are passive self-aligning waveguide sensor platforms, i.e., the waveguide sensor alignment is achieved without using any active (actuator, motor or others) element. Passive self-aligning sensors are preferable if they can satisfy the alignment accuracy and do not require future realignment. Otherwise, active means have to be provided to allow for the desired degrees of rotational adjustments. Active means may also be necessary if the sensor cylinder 200 (or its equivalent) is equipped with fewer than the necessary number of waveguide sensors to achieve the desired accuracy. In which case, the active means can be used for "fine tuning" the orientation of one or more of the waveguides 100 that make up the waveguide cylinder 200.

In the most general case, the waveguide sensors 100 or types of sensors are packaged on a sensor platform 800, preferably with all the required components such as electronics, power source and transmitter/receivers. The package 800 can then be hardened to withstand high firing and impact landing acceleration by any of the methods known in the art, such as by potting them into a single unit using potting epoxy. The packaged sensor platform 800 is then mounted on a gimbals mechanism 802 that allow the desired one, two or three degrees of independent orientation adjustment, using an appropriate actuation mechanism. Such degrees of orientation adjustment are shown schematically in FIG. 12 with Arrows 1, 2, and 3. The adjustment joints may be actuated using any type of miniaturized electrical motors such as stepper motors, DC type of motors, ultrasonic motors, inchworm motors, etc. In general, however, smaller and lighter motors are highly desired to reduce the total required volume of the package. For this reason, ultrasonic motors that can be built into the joint structure are highly desirable. When appropriate, other types of actuation mechanisms such as those operating with lead screws may be used. Lead screw driven joints provide a limited range of adjustment, but have the advantage of providing a rigid assembly once the required adjustments are made. Rotary motors such as stepper motors on the other hand require some type of braking mechanism to lock the assembly in its position following each orientation adjustment.

Figure 12:
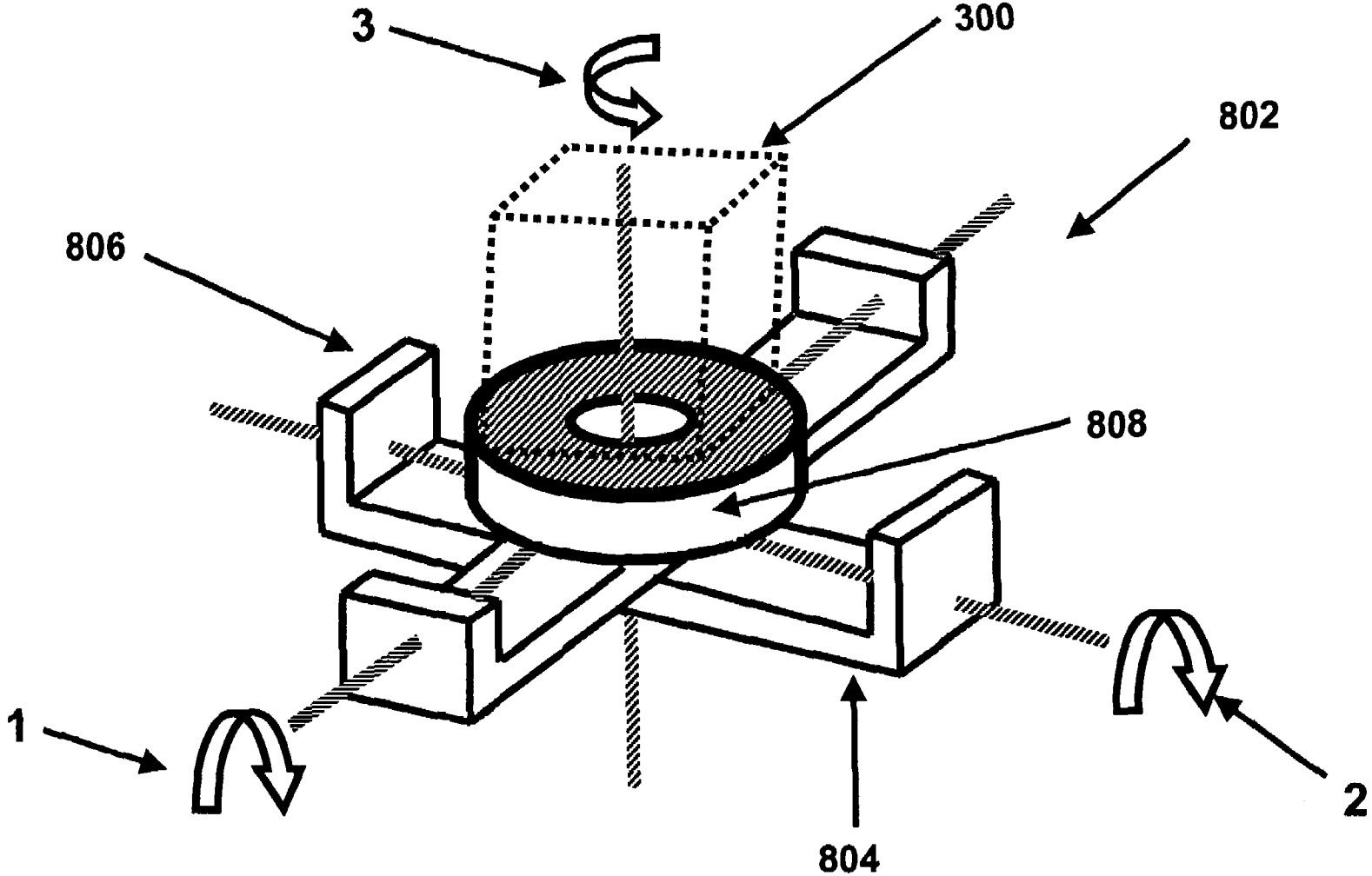
FIG. 12 illustrates a sensor package mounted to a gimbal mechanism.

An arrangement with a gimbals mechanism with three degrees of orientation adjustment is shown in FIG. 12. The gimbals mechanism consists of three rotary stages 804, 806, 808, respectively, allowing rotational adjustment in three independent directions about the axes 1, 2 and 3. In the gimbals mechanism shown in FIG. 12, the three axes of rotations are orthogonal, however, in general they can be directed in any three directions as long as they provide three independent rotational motions. Each stage 804, 806, 808 is actuated with an actuator (not shown in FIG. 12), preferably an electric motor, and preferably of an ultrasonic type or inchworm type, since when not active; it leaves the joint locked in its position. If only one degree of orientation adjustment is desired, the platform is preferably equipped with the first rotary stage only 804. The first and the second rotary stages 804, 806 are preferably used when two degrees of orientation adjustment is desired.

The gimbals mechanism 802 and the sensor package 800 can then be packaged in a deployment housing similar to those shown in FIGS. 5*a*, 5*b*, 6*a*, 6*b*, 7, 8*a*, 8*b*, 9*a*, 9*b* or 10. In general, and depending of the degree of accuracy that is desired, by packaging the gimbals mechanism 802 and the sensor package 800 in any of the housings shown in FIGS. 6*a*, 6*b*, 7, 8*a*, 8*b*, 9*a*, 9*b* and 10, the gimbals mechanism 802 will only be required to provide for rotational adjustment in the vertical direction (axis 3 in FIG. 12). This is obviously the case only if the waveguide sensor 100 spacing used in the package 800 provides the desired alignment accuracy, and also if the sensor package 800 (the sensor cylinder 200 in FIGS. 6*a*, 6*b*, 7, 8*a*, 8*b*, 9*a*, 9*b* and 10) is desired to be positioned parallel to the horizontal plane. Otherwise, if a more accurate alignment is needed or if the sensor package 800 (200) has to be oriented arbitrarily about the horizontal plane (e.g., when the sensor units are positioned on the side of a mountain or hill), then two or even three degrees of orientation adjustment may be required to achieve the desired alignment accuracy.

For the case of waveguide sensors 100, the rotational adjustment of the waveguide sensors about the axis 3, may be accomplished as described above by an actuator rotating the entire sensor cylinder about the axis 3. Rotation of all the waveguide sensors 100 packaged in a sensor package 800 (200) about the axis 3 is always appropriate for aligning one waveguide sensor 100 with a waveguide sensor 100 or source 400 positioned at another node. It may also be appropriate for aligning more than one waveguide sensor 100 with other waveguide sensors 100 and/or sources 400 if enough waveguide sensors 100 are packed around the sensor package 80 (200) to allow such alignments with the desired accuracy. However, when the achievable alignment accuracy is not enough for two or more waveguide sensors 100, the waveguide sensors 100 must be capable of being rotated relative to each other (about the axis 3).

Figure 13:
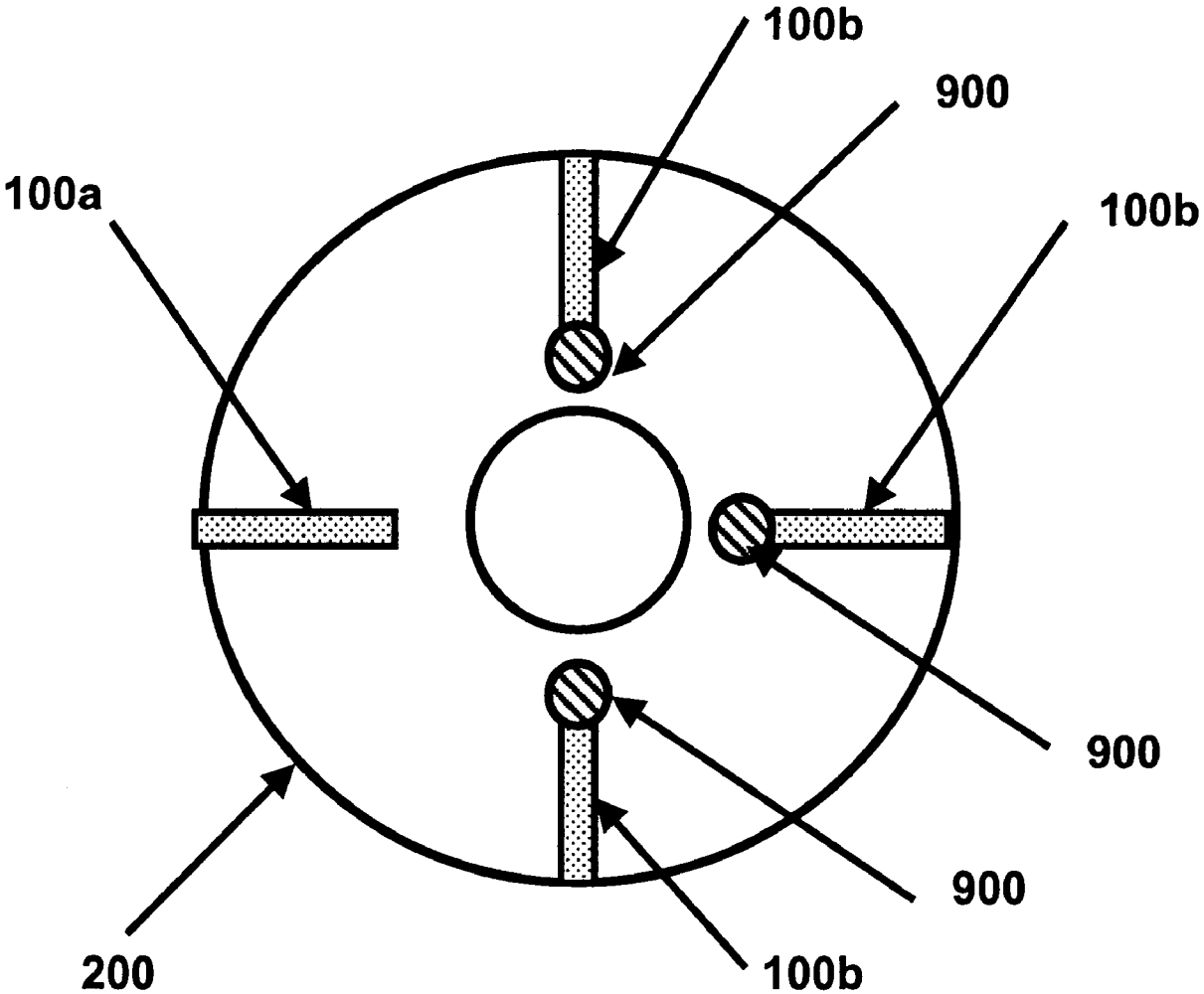
FIG. 13 illustrates a sensor cylinder having one fixed and three actuated waveguide sensors.

In one embodiment, one or more of the waveguide sensors 100 are provided with their own rotary actuators to allow them to be rotated relative to the sensor cylinder 200 (or other sensor package 800). The axis 3 actuator can then be used to rotate the sensor cylinder 200 to align one of the waveguide sensors 100 while bringing the rotary actuator equipped waveguide sensor 100 within a range that allows it to be aligned in the second required direction. A sensor cylinder 200 equipped with only one actuated waveguide sensor 100 can be used to align the actuated waveguide sensor 100 and another waveguide sensor 100 in any two arbitrary directions. When more than two waveguide sensors 100 have to be directed in arbitrary directions, then all but one waveguide sensor 100 have to be equipped with their own rotary actuators. In such cases, a limited number of actuated waveguide sensors 100 are preferably used but are provided with an enough range of rotational motion to cover the entire possible 360 degrees range of possible directions. The actual number of actuated waveguide sensors 100 on each sensor cylinder 200 is dependent on the number of possible alignment directions. The number of required actuated waveguide sensors 100 is at least one less than the total possible alignment directions (one is accounted for by one fixed waveguide sensor 100). The schematic of the top view of the sensor cylinder of such an embodiment with one fixed 100*a* and three actuated waveguide sensors 100*b* is shown in FIG. 13. Each of the actuated waveguide sensors 100*b* are operatively connected to a rotary actuator 900. All four of the waveguide sensors 100*a*, 100*b* are packaged in a sensor cylinder 200. The actuated waveguide sensors 100*b* may also be stacked one on the top of the other, and used to align each one with a different direction. Such an embodiment has the advantage of using the minimum number of waveguide sensors 100, but has the disadvantage of resulting in a taller (and wider and longer for stability reasons) sensor platform design. In such a design, there is obviously no need for the sensor cylinder and the axis 3 actuator.

Figure 14A:
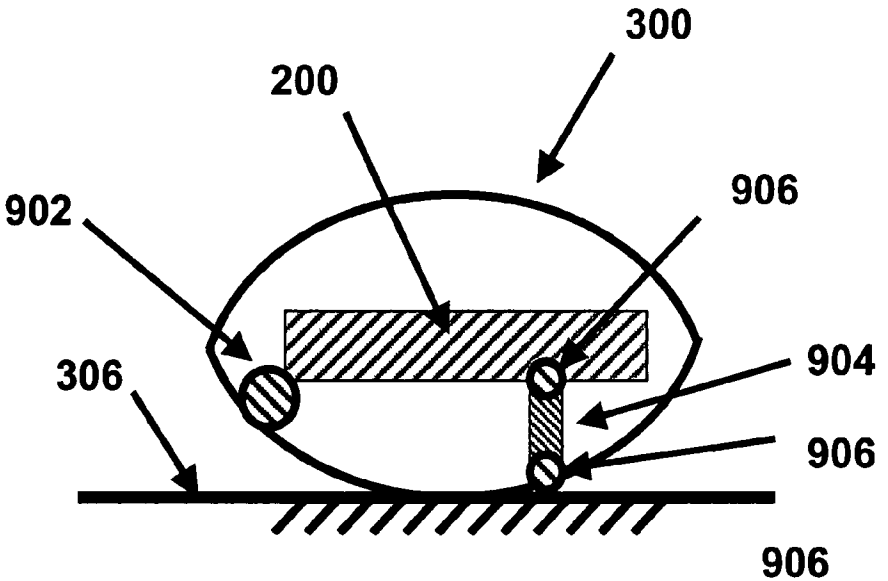
FIG. 14*a* illustrates a sectional side view of a sensor cylinder disposed in a housing where the sensor cylinder is attached to the housing by way of a spherical joint.
Figure 14B:
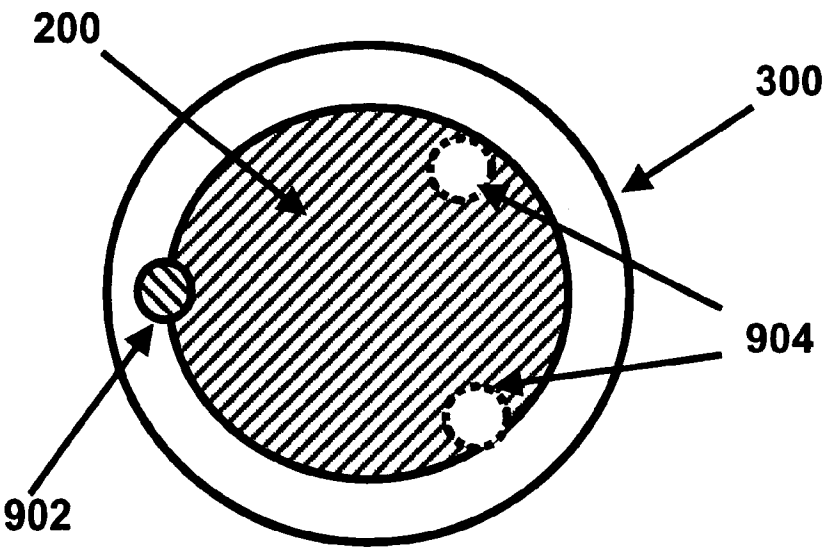
FIG. 14*b* illustrates a sectional top view of the sensor cylinder and housing of FIG. 14*a*.

In another embodiment, the sensor cylinder 200 (or any other sensor package) is mounted in a housing 300 similar to that shown in FIG. 5*a* to bring the sensor cylinder 200 to rest essentially parallel to the landing surface 306 upon landing (or in any other angular orientation relative to the landing surface by properly positioning it in the housing). The sensor cylinder 200 is attached to the housing 300 by a spherical joint 902 (or its equivalent) and with two linear actuators 904 (such as ultrasound or inchworm motors, lead-screw type actuators, etc.) as shown in FIGS. 14*a* and 14*b*. The linear actuators 904 are attached to the housing 300 structure and the sensor cylinder 200 by spherical joints 906. The displacement provided by the two linear actuators 904 will then provide the means to adjust two independent orientations of the sensor cylinder 200.

Figure 15A:
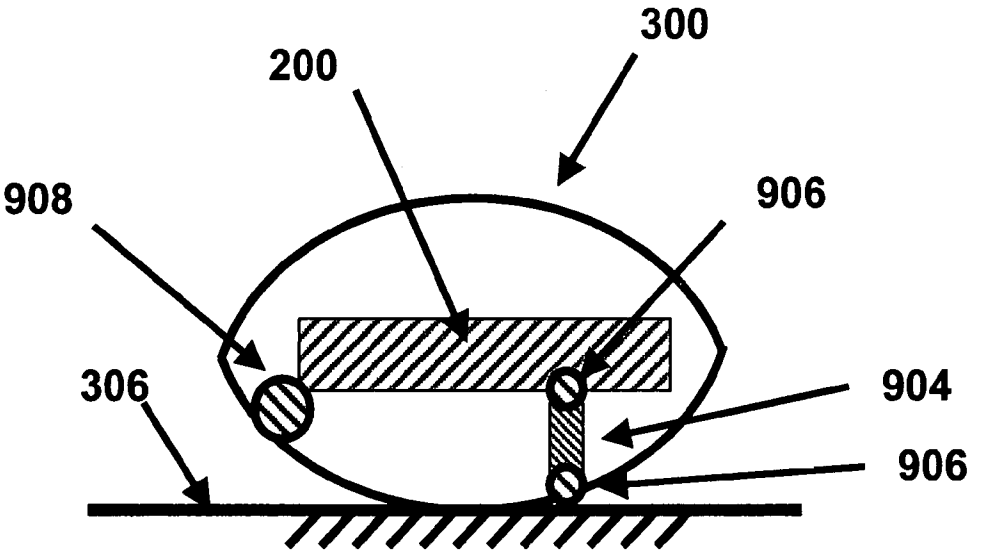
FIG. 15*a* illustrates a sectional side view of a sensor cylinder disposed in a housing where the sensor cylinder is attached to the housing by way of a revaluate joint.
Figure 15B:
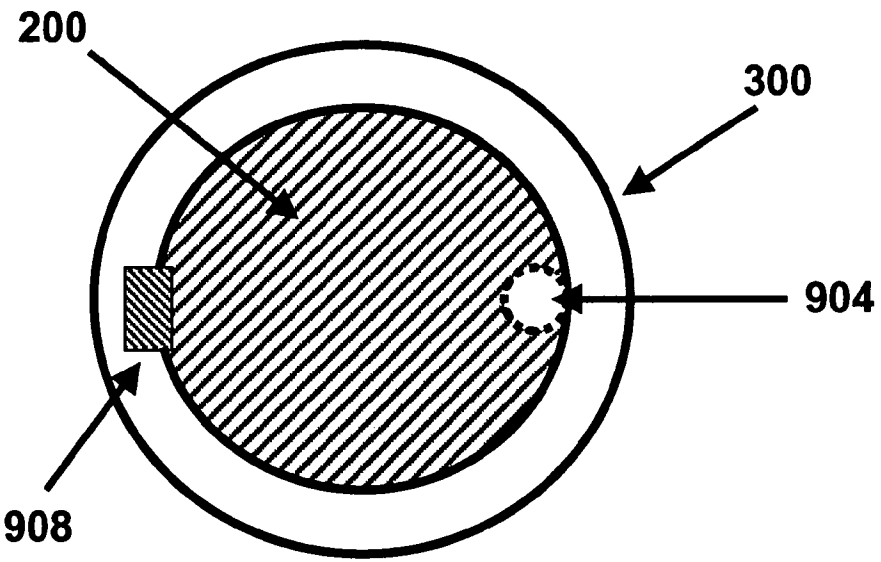
FIG. 15*b* illustrates a sectional top view of the sensor cylinder and housing of FIG. 15*a*.

In another embodiment, the sensor cylinder 200 (or any other sensor package) is attached to the housing 300 structure by a revaluate joint 908, thereby giving it only one degree of rotational adjustment. A linear actuator 904 similar to those used above for the embodiment of FIGS. 14*a* and 14*b* is then used to attach the sensor cylinder 200 to the housing 300 structure, thereby allowing the orientation of the sensor cylinder 200 about the aforementioned revaluate joint 908 to be adjusted. The schematics of such an embodiment is shown in FIGS. 15*a* and 15*b*.

It will be appreciated by those skilled in the art that any one of the linear actuators 904 used in the embodiments of FIGS. 14*a*, 14*b*, 15*a*, and 15*b* may be replaced by a rotary actuator, and provide the same rotational angle adjustment for the sensor cylinder 200 (or other sensor package).

Figure 16A:
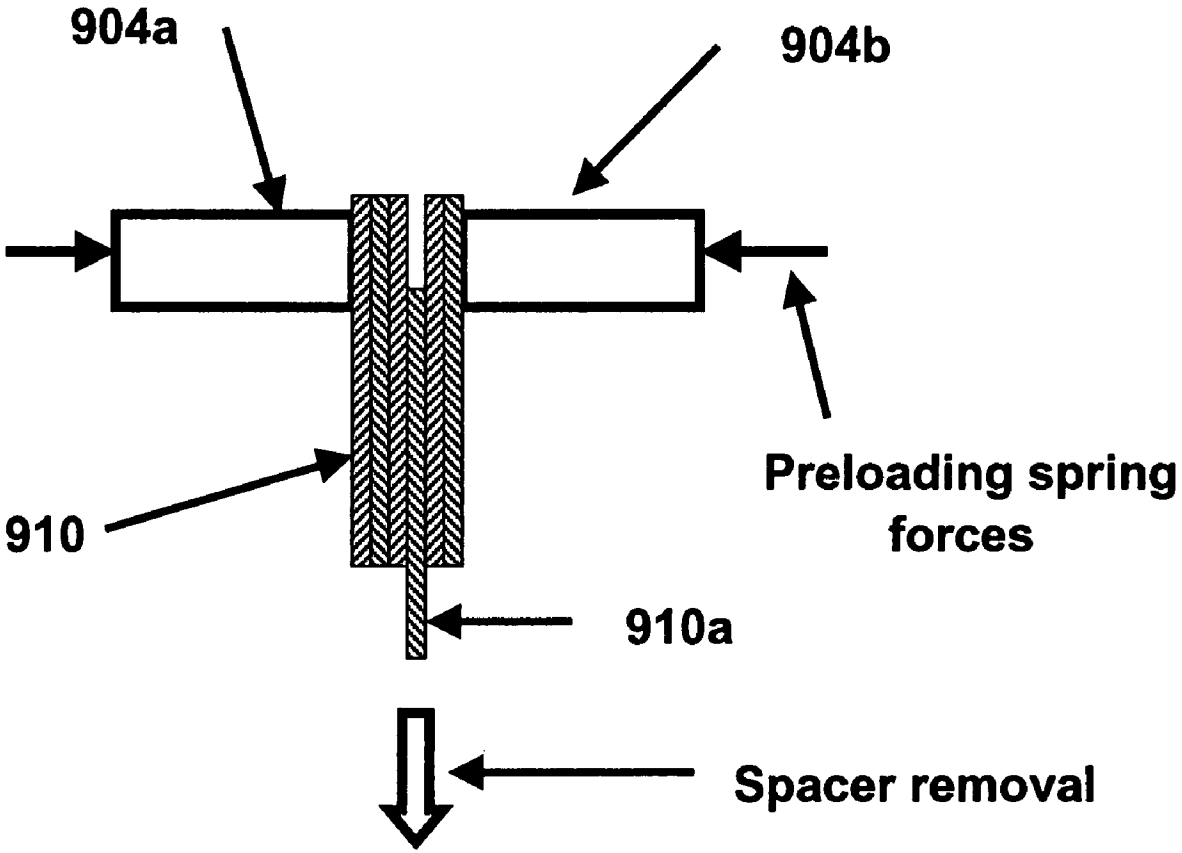
FIGS. 16*a* and 16*b* illustrate an actuator for use in the embodiments of FIGS. 12, 13, 14*a*, 14*b*, 15*a*, or 15*b*.
Figure 16B:
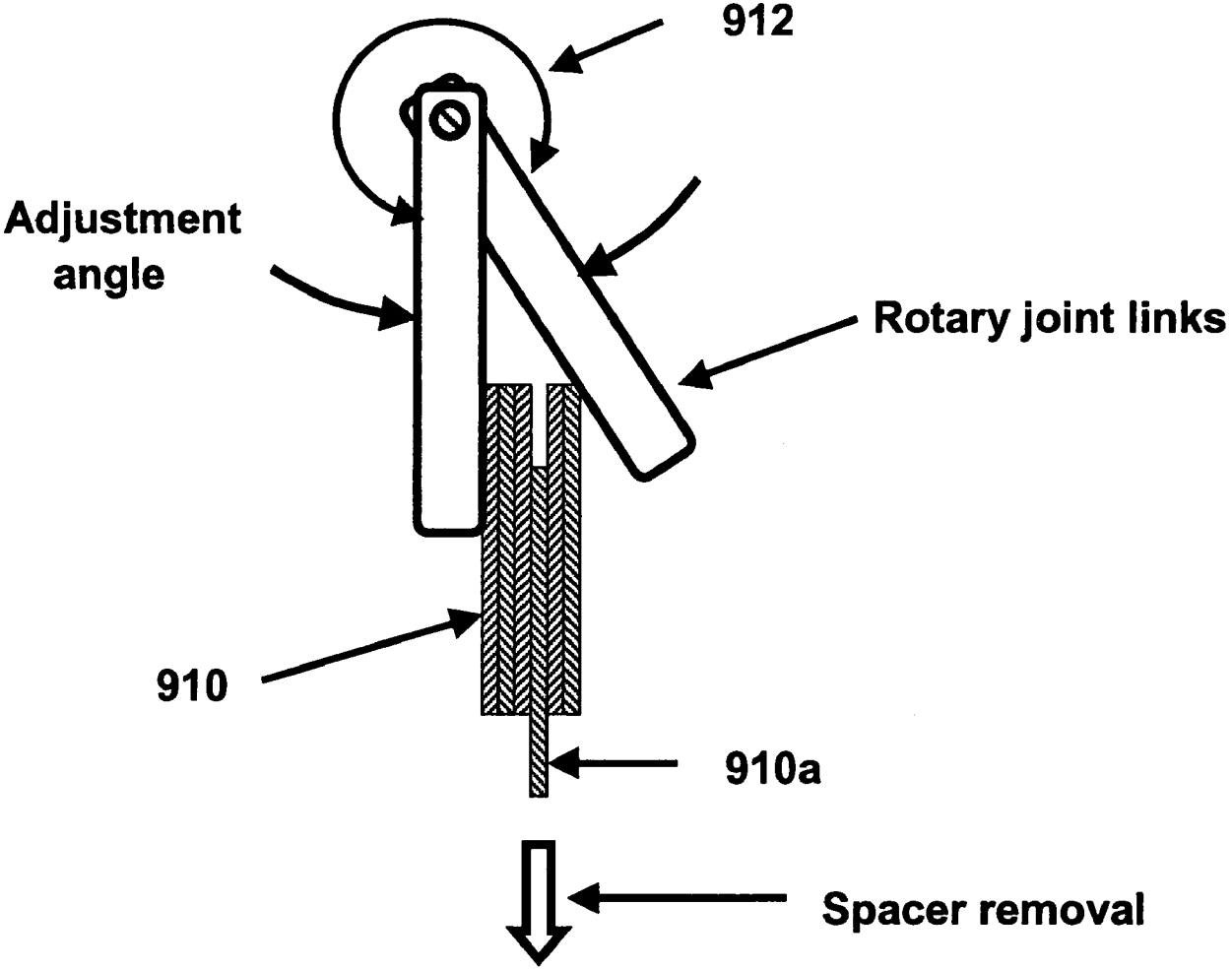

The linear and rotary actuators described above for waveguide sensor orientation adjustment all provide near continuous range of angle adjustment. In many cases, however, the required alignment accuracy may be reached by providing a limited number of, stepwise, adjustment positions (for both linear and rotational actuation). In one embodiment of such an adjustment mechanism shown in FIG. 16*a*, at least one spacer 910 is positioned between the two translating or rotating parts 904*a*, 904*b* of the actuator 904. A preloaded spring 912 shown in FIG. 16*b* holds the two moving parts together. By pulling one of the spacers 910*a* out, the two moving actuator parts 904*a*, 904*b* are brought closer together, thereby providing a step linear or rotary actuation. The spacers 910 may be pulled out using various means, such as by using a shape memory element such as a bent beam, which is attached to the spacer 910*a* or preferably forms the spacer itself. By passing a small current across the shape memory element, the shape memory element changes it shape, for example bends away and pulls the spacer 910*a* out of the space between the aforementioned two moving parts 904*a*, 904*b* of the actuator 904. The spacer 910 thickness is selected such that by pulling each spacer 910, the resulting joint motion provides a relatively small adjustment in the affected orientation, consistent with the desired accuracy of such adjustment. The process, i.e., pulling out of the spacers 910, is continued until the desired alignment accuracy is reached.

In the embodiments above, the required electronics, wiring, power sources, etc., of the sensor platforms can be packaged in-between waveguide sensors 100; in the available space around the center of the sensor cylinder 200; and/or in the top and bottom spherical sections for embodiments of FIGS. 9*a*, 9*b* and 10.

For the aforementioned sensor platforms, the illuminating polarized RF sources 400 are considered to be positioned vertically and symmetrical with respect to the horizontal plane, except for those situations in which the platforms are deployed over substantially sloped surfaces, and using embodiments shown in FIGS. 5*a*, 5*b*, and 10.

In the above embodiments, except those particularly suited to be used to align waveguide sensors 100 on significantly sloped surfaces, the illuminating sources 400 and the nodal waveguides are considered to be and preferably are positioned vertically and symmetrical with respect to the horizontal plane as shown in FIGS. 1 and 2.

During the alignment process, the strength of the signal that is received by a waveguide sensor 100 indicates how well it is aligned with the paring source 400 or waveguide sensor 100. Such alignment methods are well known in the art.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A sensor unit comprising:

a housing;

two or more individual sensors disposed in the housing; and means for aligning at least one of the two or more individual sensors with another sensor or a source to maximize a transmitted signal therebetween, the means for aligning comprises means for suspending the two or more individual sensors from the housing in a pendulum-like manner;

wherein the means for suspending comprises at least three supporting cords disposed at one end from each of a top and bottom surface of the housing and connected to a respective top and bottom surface of the sensor cylinder at another end.

2. The sensor unit if claim 1, wherein the means for aligning further comprises a sphere having a spherical surface and the two or more individual sensors comprises a plurality of individual sensors arranged about the surface of the sphere.

3. The sensor unit of claim 1, wherein the two or more individual sensors comprises a plurality of individual sensors arranged around the circumference of a circle to form a sensor cylinder.

4. The sensor unit of claim 3, wherein the sensor cylinder further comprises a top and bottom plate disposed on top and bottom surfaces, respectively, to sandwich the plurality of sensors therebetween.

5. The sensor unit of claim 3, wherein the means for aligning further comprises the housing having a cavity for accommodating the sensor cylinder, the housing shaped such that a central axis of the sensor cylinder is approximately perpendicular with a surface upon which the housing rests.

6. The sensor unit of claim 5, wherein the housing has an elliptical shape.

7. The sensor unit of claim 6, wherein the means for suspending comprises a pendulum link rotatably disposed at one end from each of a top and bottom surface of the housing to a symmetrically shaped member at another end, the sensor cylinder having a cavity having a shape for mating with each of the symmetrically shaped members and for disposing the symmetrically shaped members therein.

8. The sensor unit of claim 3, wherein the means for aligning further comprises the housing being spherical and having a cavity for accommodating the sensor cylinder and a spherical section connected to each of a top and bottom surface of the sensor cylinder.

9. A sensor unit comprising:

two or more individual sensors; and means for aligning at least one of the two or more individual sensors with another sensor or a source to maximize a transmitted signal therebetween;

wherein the two or more individual sensors comprises a plurality of individual sensors arranged around the circumference of a circle to form a sensor cylinder and the means for aligning comprises a spherical housing having a cavity for accommodating the sensor cylinder and two or more spherical rollers disposed on the sensor cylinder in contact with an interior surface of the spherical housing.

10. The sensor unit of claim 9, wherein the means for aligning further comprises a hollow cylindrical container disposed on the sensor cylinder, the hollow cylindrical container having a weight slidingly disposed therein.

* * * * *